US006203958B1

(12) United States Patent
Oya et al.

(10) Patent No.: US 6,203,958 B1
(45) Date of Patent: Mar. 20, 2001

(54) TONER AND METHOD OF IMAGE FORMATION USING THE SAME

(75) Inventors: Yasuhiro Oya; Susumu Yoshino; Masanobu Ninomiya; Hirokazu Hamano; Kaori Oishi; Tetsuya Taguchi; Koutarou Yoshihara, all of Minamiashigara (JP)

(73) Assignee: Fuji Xerox Co., LTD, Tokyo (JP)

( * ) Notice: Subject to any disclaimer, the term of this patent is extended or adjusted under 35 U.S.C. 154(b) by 0 days.

(21) Appl. No.: 09/519,473

(22) Filed: Mar. 6, 2000

(30) Foreign Application Priority Data

Jun. 8, 1999 (JP) ..... 11-161397

(51) Int. Cl.[7] ..... G03G 9/097; G03G 13/22

(52) U.S. Cl. ..... 430/110; 430/111; 430/124; 430/126

(58) Field of Search ..... 430/110, 111, 430/124, 126

(56) References Cited

U.S. PATENT DOCUMENTS

| | | | | |
|---|---|---|---|---|
| 5,288,583 | * | 2/1994 | Osumi et al. | 430/126 |
| 5,605,778 | * | 2/1997 | Onuma et al. | 430/110 |
| 5,817,443 | * | 10/1998 | Matsushima et al. | 430/111 |
| 5,840,457 | * | 11/1998 | Urawa et al. | 430/111 |
| 5,885,743 | * | 3/1999 | Takayanagi et al. | 430/111 |
| 5,976,752 | * | 11/1999 | Matsunaga et al. | 430/111 |
| 6,015,647 | * | 1/2000 | Ugai et al. | 430/110 |

FOREIGN PATENT DOCUMENTS

| | | |
|---|---|---|
| 52-003304 | 1/1977 | (JP) . |
| 1-133065 | 5/1989 | (JP) . |
| 2-100059 | 4/1990 | (JP) . |
| 2-161466 | 6/1990 | (JP) . |
| 3-122659 | 5/1991 | (JP) . |
| 3-122660 | 5/1991 | (JP) . |
| 3-122661 | 5/1991 | (JP) . |
| 3-229265 | 10/1991 | (JP) . |
| 3-260659 | 11/1991 | (JP) . |
| 3-039971 | 2/1993 | (JP) . |
| 5-158282 | 6/1993 | (JP) . |
| 6-161145 | 6/1994 | (JP) . |
| 7-084398 | 3/1995 | (JP) . |
| 10-063035 | 3/1998 | (JP) . |
| 10-207126 | 8/1998 | (JP) . |
| 10-228131 | 8/1998 | (JP) . |
| 10-254173 | 9/1998 | (JP) . |

* cited by examiner

*Primary Examiner*—Roland Martin
(74) *Attorney, Agent, or Firm*—Oliff & Berridge, PLC

(57) ABSTRACT

Provided is a toner having good offset resistance and capable of giving non-glaring, high-quality images with high OHP transparency, and a method of image formation with it. The toner includes at least a binder resin, a colorant and a wax. The THF soluble component of the toner, as analyzed through gel permeation chromatography, has a number-average molecular weight falling between 2500 and 5500, a weight-average molecular weight falling between 13000 and 25000, and a peak molecular weight falling between 5000 and 15000, and contains a fraction having a molecular weight of at least $10^5$ in a ratio of at most 10% by weight of the component and a fraction having a molecular weight of at least $10^4$ in a ratio of from 30 to 70% by weight of the component, and the wax in the toner has a DSC endothermic peak falling between 50 and 120° C.

16 Claims, 1 Drawing Sheet

TONER AND METHOD OF IMAGE FORMATION USING THE SAME

BACKGROUND OF THE INVENTION

1. Field of the Invention

The present invention relates to a toner and a method of image formation with it for electrophotography, electrostatic recording, electrostatic printing, etc. Precisely, the invention relates to a toner and a method of image formation with it favorable to duplicators, printers and others to be driven through thermal fixation.

2. Description of the Related Art

Heretofore, in general, a Carlson process is employed for image formation in duplicators, laser beam printers, etc. In a usual method of image formation, an electrostatic latent image formed optically on a photoreceptor is developed in the development step, then transferred onto a recording medium such as recording paper or the like in the transfer step, and thereafter fixed on the recording medium generally under heat and pressure in the fixing step. In that method, the photoreceptor is used repeatedly, and the toner still remaining thereon after the transfer step must be removed. Therefore, the system of image formation for the method shall be equipped with a cleaning unit.

In that system of image formation with toner, the electrostatic latent image first formed is developed through one-component development with toner only or through two-component development with toner and carrier. For the latter, used is a two-component developer in which the toner and the carrier are stirred and the toner receives frictional electrification. In the two-component development, therefore, the frictional electrification which the toner shall receive could be controlled to some degree by selecting the characteristics of the carrier and the stirring condition, and the images formed could have high quality with high reliability.

For fixing the toner image, known is a contact heat fixation system for which is used a heating roller or a heating film. The system is widely used, as its thermal efficiency is high and it enables rapid fixation.

In the fixation system, the surface of the heating member is brought into contact with a molten toner image. In the system, therefore, a part of the toner image will adhere to the heating roller and the adhered toner will be re-transferred onto the duplicated image to stain it. This problem is referred to as offset. For preventing the phenomenon of offset, the surface of the heating member may be made from a silicone rubber or fluororesin having good lubricity to toner, and a lubricant liquid such as silicone oil or the like may be applied thereto. This method will be extremely effective for preventing toner offset, but is problematic in that it requires a unit for supplying the lubricant liquid to the heating member. This is contradictory to the recent tendency in the art toward small-sized and lightweight equipment, and will be often troubled by offensive odors of the vapor of the lubricant liquid vaporized under heat. In addition, the lubricant liquid used will stain the machine units. Further, the oily lubricant liquid will remain on prints, and the prints will be sticky and unpleasant.

To overcome the problems, various methods have been proposed, including a method of specifically defining the molecular weight distribution in the resin component of toner (Japanese Patent Laid-Open Nos. 39971/1991, 158282/1993, 063035/1998, 207126/1998, 254173/1998, 228131/1998), a method of specifically defining the viscosity of toner (Japanese Patent Laid-Open Nos. 133065/1989, 161466/1990, 100059/1990, 229265/1991), a method of adding wax of, for example, resin or the like with lubricity to toner (Japanese Patent Publication No. 3304/1978), a method of specifically defining the melt viscosity of wax to be added to toner (Japanese Patent Laid-Open Nos. 260659/1991, 122660/1991), a method of specifically defining the diameter of the wax domain and the ratio of the wax to be on the surface of toner (Japanese Patent Laid-Open No. 84398/1995), and a method of specifically defining the morphology of the wax domain (Japanese Patent Laid-Open No. 161145/1994).

Also for the thermal fixation system with a heating film, various proposals have been made to ensure stable and energy-saving image fixation. For example, one method proposed for more efficiently preventing toner offset includes specifically defining the viscosity of toner components, binder resin and lubricant (Japanese Patent Laid-Open No. 122661/1991). In that manner, heretofore, various proposals have been made in the art for improving toner fixation.

In particular, ensuring both offset resistance of toner and OHP transparency of toner images involves extreme difficulties. For example, if only the binder resin for toner is specifically processed so as to make it have an increased molecular weight essentially for ensuring toner offset resistance, the OHP transparency of the toner images will be lowered and the toner images will be unfavorably darkened. Heretofore, as above, various proposals have been made to overcome the problems with toner, but, at present, none of them could sufficiently improve the fixation characteristics of toner, and satisfactory toner could not be obtained as yet. In general, usual color toner contains a binder resin having a relatively low viscosity, and oil is used in image fixation with it. However, as the viscosity of the binder resin is low, the images formed are often glaring and unpleasant to viewers.

SUMMARY OF THE INVENTION

Solving the problems as above in the related art, the present invention provides a toner having good offset resistance and capable of giving non-glaring, high-quality images with high OHP transparency, and also a method of image formation with it.

Specifically, the invention provides a toner including at least a binder resin, a colorant and a wax, which is characterized in that its THF soluble component, as analyzed through gel permeation chromatography, has a number-average molecular weight falling approximately between 2500 and 5500, a weight-average molecular weight falling approximately between 13000 and 25000, and a peak molecular weight falling approximately between 5000 and 15000, and contains a fraction having a molecular weight of at least approximately $10^5$ in a ratio of at most approximately 10% by weight of the component and a fraction having a molecular weight of at least approximately $10^4$ in a ratio of approximately from 30 to 70% by weight of the component, and that the wax therein has a DSC endothermic peak falling approximately between 50 and 120° C.

This invention also provides a method of image formation including a step of forming a latent image on a latent image carrier, a step of developing the latent image with a toner, a step of transferring the toner image from the carrier onto an image-receiving object, and a step of fixing the toner image on the image-receiving object by heating it with a heating member, wherein the toner as described above is used and the heating member has an elastic layer.

The binder resin may be a polyester resin. The surface of the toner may be coated with an inorganic powder added thereto in a ratio of approximately from 2 to 6% by weight of the toner. In the image forming method, at least the surface of the heating member to be brought into contact with the image-receiving object has a lubricant layer. In this method, the lubricant layer contains a tetrafluoroethylene/perfluoroalkyl vinyl ether copolymer, a tetrafluoroethylene/ethylene copolymer, or a tetrafluoroethylene/hexafluoroethylene copolymer. The heating member has two rolls, and the roll surface to be brought into contact with the toner image on the image-receiving object could be dented more than the other roll surface to form a nip. The heating member has a roll and a belt, and the roll is brought into contact with the toner image on the image-receiving object. The roll in contact with the toner image on the image-receiving object is dented by pressure applied thereto via the inside of the belt. The surface temperature of the heating member may be higher by at least approximately 30° C. than the DSC endothermic peak temperature of the wax in the toner. The heating member has a temperature control sensor in its non-image area. The toner may include a black toner, a yellow toner, a magenta toner and a cyan toner.

The toner image on the image-receiving object may includes a magenta or cyan toner image, a yellow toner image and a black toner image as formed in that order on the image-receiving object. The toner may includes a yellow toner, a magenta toner and a cyan toner, and the toner image on the image-receiving object includes a magenta or cyan toner image, and an yellow toner image as formed in that order on the image-receiving object.

DESCRIPTION OF THE PREFERRED EMBODIMENTS

Figure 1:
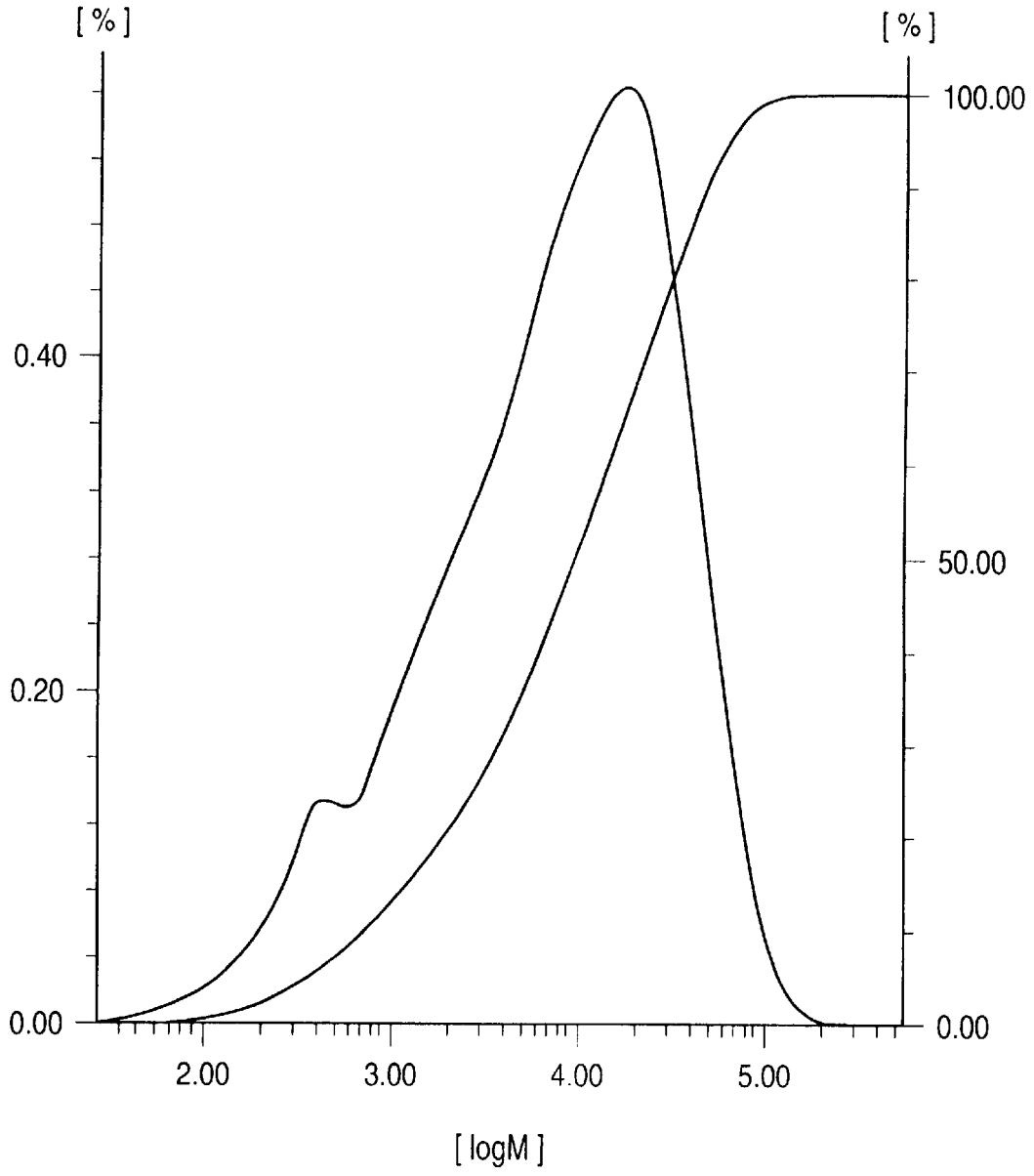
FIG. 1 is a graph showing the GPC (gel permeation chromatography) chart of the THF soluble component of the toner of Example 2 of the invention.

The toner of the invention is described in detail hereinunder.

Toner:

The toner of the invention includes at least a binder resin, a colorant and a wax, and optionally any other components.

Of the toner, the THF (tetrahydrofuran) soluble component as analyzed through gel permeation chromatography has a number-average molecular weight falling between 2500 and 5500, preferably between 3000 and 5000, more preferably between 3500 and 4500.

If the number-average molecular weight of the component is smaller than 2500, the mechanical strength of the toner will be low. If so, the toner will be too much powdered when stirred for development with it, and the toner image formed will be fogged. If so, in addition, the strength of the fixed image will be also low, and the toner will be peeled off when the image is folded. On the other hand, if the number-average molecular weight of the component is larger than 5500, the gloss of the fixed image will be low and, in addition, the saturation of the image passing through OHP will be low.

Of the toner of the invention, the THF soluble component as analyzed through gel permeation chromatography has a weight-average molecular weight falling between 13000 and 25000, preferably between 15000 and 23000, more preferably between 16000 and 20000.

If the weight-average molecular weight of the component is smaller than 13000, toner offset will be inevitable during image fixation; but, on the other hand, if larger than 25000, the gloss of the fixed image will be low and, in addition, the saturation of the image passing through OHP will be low.

Of the toner of the invention, the THF soluble component as analyzed through gel permeation chromatography has a peak molecular weight (this means the molecular weight at the peak in the molecular weight distribution curve of the component) falling between 5000 and 15000, preferably between 7000 and 15000, more preferably between 8000 and 14000.

If the peak molecular weight of the component is smaller than 5000, toner offset will be inevitable during image fixation; but, on the other hand, if larger than 15000, the gloss of the fixed image will be low and, in addition, the saturation of the image passing through OHP will be low. The molecular weight distribution curve of the component shall have the main peak molecular weight falling within the defined range, and may have any other sub-peaks or shoulders in other ranges.

Of the toner of the invention, the THF soluble component as analyzed through gel permeation chromatography contains a fraction having a molecular weight of at least $10^5$ in a ratio of at most 10% by weight of the component, preferably at most 5% by weight thereof, more preferably at most 3% by weight thereof, and contains a fraction having a molecular weight of at least $10^4$ in a ratio of from 30 to 70% by weight of the component, preferably between 35 and 65% by weight thereof, more preferably between 40 and 60% by weight thereof.

If the fraction of the component having a molecular weight of at least $10^5$ is larger than 10% by weight of the component and if the fraction thereof having a molecular weight of at least $10^4$ is larger than 70% by weight of the same, the offset resistance of the toner will be good. If so, however, the gloss of the fixed image will be low and, in addition, the saturation of the image passing through OHP will be low. On the other hand, if the fraction of the component having a molecular weight of at least $10^4$ is smaller than 30% by weight of the component, the offset resistance of the toner will be poor. Regarding the two requirements for the molecular weight distribution in the component, either one of them, if satisfied, could improve any of the gloss of the fixed image, the saturation of the image passing through OHP and the offset resistance of the toner in some degree. However, in order to improve all these properties of the toner for image formation to a desired degree, the molecular weight distribution in the component must satisfy both the two requirements falling within the defined ranges.

Above molecular weight distribution (a number-average molecular weight, a weight-average molecular weight, a peak molecular weight, a molecular weight of at least approximately $10^5$, a molecular weight of at least approximately $10^4$) of toner is measured the THF soluble component of total of all toner composition (mixture of binder resin (one kind or more) and wax and pigment and other addition), not only binder resin.

The wax to be in the toner of the invention has a DSC endothermic peak falling between 50 and 120° C., preferably between 60 and 115° C., more preferably between 70 and 110° C. If the endothermic peak in the DSC curve of the wax, as analyzed through differential scanning calorimetry (DSC), is lower than 50° C., toner blocking will be inevitable. On the other hand, if the peak is higher than 120° C., the fixed toner image could not be smoothly released from the heating member at low temperatures. If so, the image-receiving object having the fixed image thereon will be nipped by the heating member and, in addition, toner offset will be inevitable.

Only when satisfying the physical requirements defined above, the toner of the invention could have good offset resistance and could form non-glaring, high-quality images with high OHP transparency. The physical data of the toner could be controlled to fall within the defined ranges by suitably selecting the type of the monomers for the binder resin, and also the polymerization temperature and the polymerization time for the monomers.

Binder Resin:

Any known binder resin is usable for the toner of the invention.

The binder resin includes, for example, homopolymers and copolymers of styrenes such as styrene, chlorostyrene, etc.; mono-olefins such as ethylene, propylene, butylene, isoprene, etc.; vinyl esters such as vinyl acetate, vinyl propionate, vinyl benzoate, etc.; aliphatic α-methylene-carboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc.

Specific examples of the binder resin are polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes, polypropylenes, etc. Also usable as the binder resin are polyesters, polyurethanes, epoxy resins, silicone resins, polyamides, modified rosins, paraffins, and waxes. Of those, polyester resins are especially preferred for the binder resin, as capable of more effectively improving the low-temperature fixability, the offset resistance and the blocking resistance of the toner.

The polyester resins for use in the invention may be produced through polycondensation of a polyol component and an acid component.

The polyol component includes, for example, ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane-dimethanol, hydrogenated bisphenol A, bisphenol A-ethylene oxide adduct, bisphenol A-propylene oxide adduct, etc.

The acid component includes, for example, maleic acid, phthalic acid, isophthalic acid, terephthalic acid, succinic acid, dodecenylsuccinic acid, trimellitic acid, pyromellitic acid, cyclohexane-tricarboxylic acid, 1,5-cyclohexane-dicarboxylic acid, 2,5,7-naphthalene-tricarboxylic acid, 1,2,4-naphthalene-tricarboxylic acid, 1,2,5-hexane-tricarboxylic acid, and their anhydrides.

Especially preferred are the resins having a softening point falling between 90 and 150° C., a glass transition point falling between 55 and 75° C., an acid value falling between 1 and 40, and a hydroxyl value falling between 5 and 40.

Wax:

The wax for use in the invention includes, for example, paraffin wax and its derivatives, montan wax and its derivatives, microcrystalline wax and its derivatives, Fisher-Tropsch wax and its derivatives, polyolefin wax and its derivatives, etc. The derivatives include oxides, polymers with vinyl monomers, derivatives as modified through grafting, etc. Apart from these, also usable herein are alcohols, fatty acids, vegetable waxes, animal waxes, mineral waxes, ester waxes, acid amides, etc.

The amount of wax to be in the toner is preferably from 1 to 10% by weight of the toner, more preferably from 3 to 8% by weight. If the amount is smaller than 1% by weight, one will often fail to obtain a lot of fixation latitude (the fixation latitude indicates the fixing roll temperature range within which toner fixation is possible without offset); but if larger than 10% by weight, an increased amount of wax will be released from the toner to worsen the powdery fluidity of the toner. If so, in addition, the free wax having been released from the toner will adhere onto the surface of the photoreceptor on which an electrostatic latent image is formed, and, as a result, correctly forming an electrostatic latent image on the photoreceptor will be often impossible.

Colorant:

Typically, the colorant to be in the toner of the invention includes carbon black, nigrosine, aniline blue, chalcoyl blue, chrome yellow, ultramarine blue, DuPont oil red, quinoline yellow, methylene blue chloride, phthalocyanine blue, malachite green oxalate, lamp black, rose bengale, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Yellow 180, C.I. Pigment Blue 15:1, C.I. Pigment Blue 15:3, etc.

Also employable herein are a flashed pigment product to be prepared by kneading an aqueous pigment paste and a binder resin under normal pressure at a temperature not lower than the softening point of the resin followed by flashing the resulting mixture; and high-concentration pigment pellets to be prepared by heating and melting a dry pigment for the colorant and a binder resin followed by mixing them with high shearing force applied thereto, for example, by mixing them in a two-roll or three-roll heating unit or the like. From the viewpoint of the colorant dispersibility, the latter are preferred.

The amount of the colorant to be in the toner of the invention preferably falls between 0.5 and 15 parts by weight relative to 100 parts by weight of the binder resin, more preferably between 1 and 10 parts by weight. If the amount is smaller than 0.5 parts by weight, the coloring power of the toner will be low. If, on the other hand, the amount is larger that 15 parts by weight, the transparency of the toner images formed will be low.

A part or all of the colorant to be in the toner of the invention may be a magnetic powder to give a one-component magnetic developer. For the magnetic powder to be dispersed in the binder resin, usable are any known magnetic substances including, for example, metals such as iron, cobalt, nickel, etc.; their alloys; metal oxides such as $Fe_3O_4$, $\gamma$-$Fe_2O_3$, cobalt-doped iron oxide, etc.; ferrites such as MnZn ferrite, NiZn ferrite, etc.; magnetites, hematites, etc. The magnetic substances may be processed with a surface-treating agent such as a silane coupling agent, a titanate coupling agent, etc., or may be coated with polymer.

The blend ratio of the magnetic powder preferably falls between 30 and 70% by weight of the toner grains, more preferably between 35 and 65% by weight. If the amount of the magnetic powder is smaller than 30% by weight, the toner binding force of the magnet that carries the toner will be low. If so, the toner will scatter, and the toner images formed will be fogged. On the other hand, if the amount of the magnetic powder is larger than 70% by weight, the image density will be low. Preferably, the mean grain size of the magnetic powder falls between 0.05 and 0.35 $\mu$m or so in view of the dispersibility of the powder in the binder resin.

Other Components:

The toner of the invention may optionally contain any other components of internal additives, such as an charge controlling agent, a wax dispersion promoter, etc. Also optionally, inorganic powder and resin powder may be added to the toner, either alone or as combined, to coat the surface of the toner grains for further improving the long-term storage stability, the fluidity, the developability and the transferability of the toner.

The inorganic powder includes, for example, carbon black, silica, alumina, titania, zinc oxide, metatitanic acid compounds, etc. One or more of these powdery substances may be used herein either singly or as combined. The total amount of the inorganic powder that may be added to the toner of the invention preferably falls between 2 and 6% by weight of the toner grains, more preferably between 2.5 and 5% by weight.

The resin powder includes, for example, spherical grains of PMMA, nylon, melamine, benzoguanamine, fluororesin, as well as amorphous powder of polyvinylidene chloride, metal salts of fatty acids, etc. The amount of the resin powder that may be added to the toner of the invention preferably falls between 0.1 and 4% by weight of the toner grains, more preferably between 0.5 and 3% by weight.

The powder to coat the surface of the toner may be optionally processed for intended surface treatment of the powder.

The toner particles of the invention may have a volume-average particle size of at most about 30 $\mu$m, preferably from 3 to 20 $\mu$m, more preferably from 5 to 9 $\mu$m.

The toner of the invention may be for any of one-component development or two-component development, but is preferably combined with a resin-coated carrier for two-component development. The resin-coated carrier is preferred, as improving the electrification rising and the electrification distribution in the toner even though having a reduced grain size, and preventing the background staining and the image density fluctuation that may be caused by the reduction in the toner electrification.

The carrier for use in the invention is not specifically defined, and any known carrier is usable herein. It includes, for example, an iron powder carrier, a ferrite carrier, a surface-coated ferrite carrier, etc. The grain size of the carrier may fall between 20 and 100 $\mu$m or so, preferably between 25 and 60 $\mu$m.

Production of Toner:

The toner of the invention may be produced in any methods. For example, one method employable for producing the toner includes a melt-kneading step of blending the constituent components in a three-roll kneader, a single-screw kneader, a double-screw kneader, a Banbury mixer or the like; a grinding step of mechanically powering the resulting blend, for example, in an impact grinder or the like; a classification step of dressing the resulting grains by the use of a centrifugal classifier, a Coanda-effect classifier or the like; a step of adding external additives to the classified grains by the use of a V-type blender, a Henschel mixer, a mechanofusing machine or the like; and a step of sieving the grains through a sieve with 20 to 200 $\mu$m meshes or the like. Another method also employable for it includes a polymerizing step of preparing a toner matrix in wet followed by the external additives-adding step and the sieving step as above.

Method of Image Formation:

The imaging method of the invention is described below.

The method includes a step of forming a electrostatic latent image on a latent image carrier, a step of developing the electrostatic latent image with a toner, a step of transferring the toner image onto an image-receiving object, and a step of fixing the toner image on the image-receiving object by heating it with a heating member. In the method, used is the toner of the invention described hereinabove, and the heating member has an elastic layer. The method is free from toner offset and gives non-glaring, high-quality images with high OHP transparency, as the toner of the invention is used therein.

The elastic layer of the heating member acts to improve the quality of the images to be formed, and it may be made of a silicone rubber, a fluororubber material or the like.

The thickness of the elastic layer may vary, depending on its object, but preferably falls between 0.5 and 5.0 mm.

Preferably, the heating member has a lubricant layer. The lubricant layer is for preventing toner adhesion to the member, and is preferably made of a material with good lubricity to toner, such as a silicone rubber, a fluororesin or the like.

Specific examples of the fluororesin include a tetrafluoroethylene/perfluoroalkyl vinyl ether copolymer, a tetrafluoroethylene/ethylene copolymer, and a tetrafluoroethylene/hexafluoroethylene copolymer.

The thickness of the lubricant layer may vary, depending on its object, but preferably falls between 10 and 60 $\mu$m.

In the method of the invention, the amount of the lubricant liquid such as silicone oil or the like that may be applied to the heating member is desirably as small as possible. The lubricant liquid will be effective for extending the fixation latitude. However, as being transferred onto the image-receiving object along with a toner image to be fixed on the object, the lubricant liquid is problematic in that it makes the image-having object sticky, that an adhesive tape could not be adhered onto the object, and that letters could not be written on the object with an oily ink pen. The problem is noticeable with OHP. Moreover, since the lubricant liquid could not smooth the rough surface of the object having an image thereon, it often lowers the OHP transparency of the image-having object.

The toner of the invention, having the constitution as above, allows a lot of fixation latitude. Therefore, the amount of the lubricant oil such as silicone oil or the like to be applied to the fixing roll in the imaging method where the toner of the invention is used could be minimized. For example, the amount of the lubricant oil to be used in the imaging method of the invention could be at most 1 $\mu$l per one A4-size sheet of printing paper. Within that range, the lubricant oil, even if used, would be substantially free from the problems noted above. Since the toner of the invention, having the constitution as above, allows a lot of fixation latitude even in the absence of a lubricant liquid, a lubricant liquid-coating unit could be omitted in the apparatus for the imaging method of the invention, for the purpose of reducing the space for the apparatus.

Where the heating member for use in the imaging method of the invention has two rolls, it is desirable that the roll surface to be brought into contact with the toner image on the image-receiving object is dented more than the other roll surface to form a nip. In that condition, the image-receiving object could be prevented from winding around the roll. For example, the thickness of the elastic layer of the roll to be brought into contact with the toner image on the image-receiving object is controlled to be 2 mm, while the thickness of the elastic layer of the other roll is controlled to be 1 mm; or alternatively, the elastic layers of the two rolls have the same thickness, but either one of them to be brought into contact with the toner image is controlled to have a lower hardness than the other. Between those two rolls, the toner image-having object may be pressed whereby the image is well fixed on the object. Immediately having passed through the fixing rolls, the image-having object could be released from the two rolls in the direction in which the object is well separated from the roll that was contacted with the toner image on the object. In that condition, the image-having object could be prevented from winding around the roll.

Also preferably, the heating member for use in the imaging method of the invention has one roll as combined with a belt, and the roll is brought into contact with the toner image on the image-receiving object. This embodiment is preferred, as the heat capacity of the belt is small and therefore the power for the heating member could be small. The belt is preferably made of a heat-resistant material of, for example, tetrafluoroethylene, polyimide or the like. The thickness of the belt is preferably not larger than 2 mm, and is preferably coated with a fluororesin like that for the heating member. In this embodiment, it is desirable that the roll in contact with the toner image on the image-receiving object is dented by pressure applied thereto via the inside of the belt. To apply the pressure to the fixing roll, for example, used is a pressure roll or the like via the belt. Immediately having passed between the fixing roll and the belt, the image-having object could be released from them in the direction in which the object is well separated from the fixing roll that was contacted with the toner image on the object. In that condition, the image-having object could be prevented from winding around the roll.

Also preferably, the surface temperature of the heating member is higher by at least 30° C., more preferably by at least 50° C. than the DSC endothermic peak temperature of the wax to be in the toner used in the imaging method. If not, or that is, if the surface temperature of the heating member is not higher by at least 30° C. than the DSC endothermic peak temperature of the wax, the wax could not sufficiently exhibit its lubricating capability.

Where the heating member is equipped with a contact-type temperature control sensor such as a thermocouple or the like, it is desirable that the sensor is in the non-image area of the heating member. This is because the surface of the heating member to be used in the imaging method of the invention is readily worn, being different from a usual heating member that requires a large amount of a lubricant liquid, and if the temperature control sensor is in the image area of the heating member, it will cause image defects. The non-image area of the heating member includes not only the area thereof through which printing paper does not pass but also the area thereof through which the non-image margin of printing paper passes.

In full color image formation according to the imaging method of the invention, preferably, the toner to be used does not include a black toner, or that is, the toner includes an yellow toner, a magenta toner and a cyan toner to form a toner image including a magenta or cyan toner image and an yellow toner image in that order on the image-receiving object. In this preferred embodiment, the transparency of the yellow toner image is higher than that of any other toner images, and therefore the quality of the color image formed is high.

Where the toner for forming images includes a black toner, it is desirable that the toner image to be formed on the image-receiving object includes a magenta or cyan toner image, an yellow toner image and a black toner image in that order on the object. In this embodiment, the letters formed of the black toner are not blurred, and the quality of the color image formed is high.

EXAMPLES

The invention is described in more detail with reference to the following Examples, which, however, are not intended to restrict the scope of the invention. In the following Examples, parts are all by weight, unless otherwise specifically indicated.

Example 1

| | |
|---|---|
| Polyester Resin | 88 parts |

(prepared from terephthalic acid/bisphenol A-ethylene oxide adduct/trimellitic acid anhydride; Tg=62° C., Mn=5320, Mw=24500, acid value=17, hydroxyl value=33)

| | |
|---|---|
| Polyethylene Wax | 7 parts |

(Polywax 725 from Toyo Petrolite; DSC endothermic peak, 102° C.)

To these components, added is any of the following pigments to prepare an yellow toner, a magenta toner, a cyan toner and a black toner. Except for the black pigment, all the pigments are flashed with the polyester resin.

| | |
|---|---|
| Yellow Pigment (C.I. Pigment Yellow 180) | 5 parts |
| Magenta Pigment (C.I. Pigment Red 122) | 5 parts |
| Cyan Pigment (C.I. Pigment Blue 15:3) | 5 parts |
| Black Pigment (Carbon Black #25B from Mitsubishi Chemical) | 5 parts |

Each mixture is pre-mixed, then kneads in an extruder with each 5 wt % water injection at 2 point (middle point of extruder and just before the end of extruder), and mills in a jet mill. The resulting powder is classified in a Coanda-effect classifier to obtain classified toner particles of each color. The volume-average particle size of the yellow toner is 6.5 μm, that of the magenta toner is 7.0 μm, that of the cyan toner is 6.1 μm, and that of the black toner is 8.0 μm. To 100 parts of each toner, added are 1.0 part of hydrophobic titanium oxide (mean grain size, 30 nm) and 1.5 parts of hydrophobic, fine silica powder (mean grain size, 50 nm), and mix in a Henschel mixer. The resulting mixture is sieved through a 38 μm-mesh sieve to obtain a sieved toner of each color.

These toners are separately mixed with a ferrite carrier coated with a styrene-methyl methacrylate copolymer and having a mean grain size of 40 μm to prepare different color developers each having a toner concentration of 8%.

Two rolls for the heating member for toner fixation are prepared. Precisely, an aluminium pipe having a diameter of 50 mm is coated with an elastic layer of silicone rubber having a thickness of 2 mm, and this is covered with a tubular lubricant layer of a tetrafluoroethylene/perfluoroalkyl vinyl ether copolymer having a thickness of 30 μm. The roll thus prepared is to be contacted with the non-fixed toner on an image-receiving object. Another roll is prepared in the same manner as herein, except that the thickness of the silicone rubber layer is varied to 1 mm.

The developers and the heating member for toner fixation are set in a duplicator modified from Fuji Xerox's A-Color 935 Duplicator, and test for the properties of the toners used. The heating member is equipped with a contact-type thermocouple serving as a temperature control sensor, in its area through which printing paper does not pass. With the sensor, the temperature of the heating member is controlled to vary within the range of from 130 to 200° C. in the fixation latitude test. In this test, the toner image to be formed on the image-receiving object is controlled to include cyan, magenta, yellow and black in that order.

Example 2

| | |
|---|---|
| Polyester Resin | 88 parts |

(prepared from terephthalic acid/bisphenol A-ethylene oxide adduct/trimellitic acid anhydride; Tg=62° C., Mn=4100, Mw=16800, acid value=17, hydroxyl value=33)

| | |
|---|---|
| Carnauba Wax | 7 parts |

(purified granular carnauba wax from Toa Chemical; DSC endothermic peak, 82° C.)

To these components, added is any of the following pigments to prepare an yellow toner, a magenta toner, a cyan toner and a black toner. Except for the black pigment, all the pigments are flashed with the linear polyester resin.

| | |
|---|---|
| Yellow Pigment (C.I. Pigment Yellow 180) | 10 parts |
| Magenta Pigment (C.I. Pigment Red 57:1) | 5 parts |
| Cyan Pigment (C.I. Pigment Blue 15:3) | 5 parts |
| Black Pigment (Carbon Black #25B from Mitsubishi Chemical) | 5 parts |

In the same manner as in Example 1, these mixtures are processed to give different color toners, which are then formulated into different color developers. The toners are tested in the same manner as in Example 1.

Example 3

Different color toners are prepared in the same manner as in Example 1, except that the following polyester resin is used herein. These color toners are formulated into different color developers also in the same manner as in Example 1. The toners are tested in the same manner as in Example 1.

Polyester Resin (prepared from terephthalic acid/bisphenol A-ethylene oxide adduct/cyclohexane-dimethanol; Tg=60° C., Mn=3500, Mw=20000, acid value=7, hydroxyl value=20).

Example 4

Different color toners are prepared in the same manner as in Example 1, except that the following polyester resin is used herein. These color toners are formulated into different color developers also in the same manner as in Example 1. The toners are tested in the same manner as in Example 1.

Polyester Resin (prepared from terephthalic acid/bisphenol A-ethylene oxide adduct/cyclohexane-dimethanol; Tg=60° C., Mn=3000, Mw=19000, acid value=27, hydroxyl value=36).

Example 5

The same toners as in Example 1 are tested in the same manner as therein. In this, however, the mechanism of the heating member used for toner fixation differs from that in Example 1. Precisely, in the heating member used herein, the roll not to be brought into contact with the non-fixed toner on the image-receiving object is replaced with a polyimide belt (thickness, 500 $\mu$m) coated with a tetrafluoroethylene/perfluoroalkyl vinyl ether copolymer (PFA). Via the belt, a roll (diameter, 10 mm) coated with a silicone rubber layer (thickness, 1 mm) is pressed against the roll that is in contact with the non-fixed toner on the image-receiving object, to form a nip.

Example 6

Different color toners are prepared in the same manner as in Example 2, except that the following polyester resin is used herein and the following low molecular weight resin is used herein additionally. These color toners are formulated into different color developers also in the same manner as in Example 2. The toners are tested in the same manner as in Example 1.

Polyester Resin (prepared from terephthalic acid/trimellitic acid/bisphenol A-ethylene oxide adduct/bisphenol A-propylene oxide adduct; Tg=69° C., Mn=7200, Mw=19000, peak molecular weight=9800, acid value=24, hydroxyl value=14, no THF insoluble content).

| | |
|---|---|
| Low molecure weight copolymer resin (prepared from isopropenyltoluene/indene: 50%/50%, Tg = 78° C., Mn = 1200, Mw = 2000) | 7 parts |

Comparative Example 1

Different color toners are prepared in the same manner as in Example 1, except that the following polyester resin is used herein. These color toners are formulated into different color developers also in the same manner as in Example 1. The toners are tested in the same manner as in Example 1.

Polyester Resin (prepared from terephthalic acid/bisphenol A-ethylene oxide adduct/trimellitic acid anhydride; Tg=65° C., Mn=4000, Mw=21000, acid value=22, hydroxyl value=30).

Comparative Example 2

Different color toners are prepared in the same manner as in Example 1, except that the following polyester resin is used herein. These color toners are formulated into different color developers also in the same manner as in Example 1. The toners are tested in the same manner as in Example 1.

Polyester Resin (prepared from terephthalic acid/bisphenol A-ethylene oxide adduct/trimellitic acid anhydride; Tg=65° C., Mn=2400, Mw 11000, acid value=28, hydroxyl value=38).

Comparative Example 3

Different color toners are prepared in the same manner as in Example 1, except that the following polyester resin is used herein. These color toners are formulated into different color developers also in the same manner as in Example 1.

The toners are tested in the same manner as in Example 1.

Polyester Resin (prepared from terephthalic acid/bisphenol A-ethylene oxide adduct/trimellitic acid anhydride; Tg=68° C., Mn=6100, Mw=28900, acid value=15, hydroxyl value=29).

Comparative Example 4

Different color toners are prepared in the same manner as in Example 1, except that the following polyester resin is used herein. These color toners are formulated into different color developers also in the same manner as in Example 1. The toners are tested in the same manner as in Example 1.

Polyester Resin (prepared from terephthalic acid/bisphenol A-ethylene oxide adduct/trimellitic acid anhydride; Tg=68° C., Mn=5350, Mw=45000, acid value=18, hydroxyl value=24).

Molecular Weight Distribution in Toner:

The THF soluble component of each toner sample is analyzed for the molecular weight distribution therein, under the condition mentioned below.

A system of Toso's HLC-8120 GPC with SC-8020 columns with TSK gel, Super HM-H (6.0 mm ID×15 cm×2) is used. The eluent used is tetrahydrofuran (first-grade chemical reagent from Junsei Chemical, containing a stabilizer). The flow rate is 0.6 ml/min. The amount of the sample introduced into the system is 10 $\mu$l. The controlled temperature is 40° C. The detector used is an RI detector. The sample concentration is 0.5%. Ten samples of A-500, F-1, F-10, F-80, F-380, A-2500, F-4, F-40, F-128 and F-700 are analyzed based on their calibration curves.

FIG. 1 shows the GPC (gel permeation chromatography) chart of the THF soluble component of the toner of Example 2. As in FIG. 1, the fraction appearing at log M of not smaller than 4.00, or that is, the fraction having a molecular weight of not smaller than $10^4$ accounts for about 55% by weight of the THF soluble component of the toner. The chart gives a peak for the molecular weight of about 360, which is derived from the eluent used and shall be excluded from the data for number-average and weight-average molecular weight analysis. In this case illustrated, the fractions having a molecular weight of not smaller than 450 were analyzed for the molecular weight distribution.

The GPC data of the molecular weight distribution in the THF soluble component of each toner sample produced herein are given in Table 1 below.

TABLE 1

| | Number-Average Molecular Weight | Weight-Average Molecular Weight | Peak Molecular Weight | Fraction with Molecular Weight ≧ $10^5$, wt. % | Fraction with Molecuiar Weight ≧ $10^4$, wt. % |
|---|---|---|---|---|---|
| Example 1 | 5200 | 24200 | 13000 | 5 | 65 |
| Example 2 | 4000 | 16200 | 13500 | 3 | 52 |
| Example 3 | 3400 | 18000 | 6000 | 2 | 61 |
| Example 4 | 2950 | 18400 | 5000 | 0 | 32 |
| Example 5 | 5200 | 24200 | 13000 | 5 | 65 |
| Example 6 | 4600 | 15300 | 8400 | 8 | 45 |
| Comp. Ex. 1 | 3950 | 20800 | 16000 | 5 | 44 |
| Comp. Ex. 2 | 2350 | 10700 | 8400 | 0 | 28 |
| Comp. Ex. 3 | 6000 | 28500 | 15000 | 11 | 72 |
| Comp. Ex. 4 | 5300 | 44600 | 12500 | 15 | 67 |

Image Gloss on Plain Paper:

The image gloss on plain paper samples printed at the lowermost fixation temperature is measured with a glossmeter, Murakami Color Technology Laboratory's Model GM-26D (for 75 degrees). Fuji Xerox's paper J is used as the printing paper. The maximum value of the secondary colors of red, blue and green of each image measure with the glossmeter indicates the image gloss of each sample. The samples having an image gloss of smaller than 40 are not good in point of the color reproducibility and the image quality; and those having an image gloss of larger than 75 are also not good as glaring. The samples having an image gloss of from 40 to 60 are good and are on the practical level. The data obtained are given in Table 2 below.

OHP Transparency:

Fuji Xerox's OHP sheets, V516 are printed with each toner sample. The printed sheets are projected through an overheat projector, Fuji Xerox's OHP ZM Model, and the images are sensually evaluated for the transparency. Clear images are good (○), but cloudy images are not good (X), as in Table 2.

Offset:

Fuji Xerox's paper J is used as the printing paper. The printed samples are macroscopically observed for the presence or absence of offset. Those with no offset at the temperature indicated in Table 2 are good (○), but those with offset are not good (X), as in Table 2.

Lowermost Fixation Temperature:

Solid images of monochromatic colors of cyan, magenta and yellow and secondary colors of red, blue and green are all tested. The image-printed samples are once folded and again unfolded, and the degree of the toner having peeled from each sample is measured. The width around the folded line from which the toner had peeled off is measured in each sample. The fixation temperature for the samples in which the toner-peeled width measured for all colors is not larger than 0.5 mm indicates the lowermost fixation temperature for the samples. The samples for which the lowermost fixation temperature is not higher than 160° C. are on the practical level. The data obtained are given in Table 2.

Fixation Latitude:

The fixation latitude covers the temperature range from the lowermost fixation temperature up to the offset temperature. The samples for which the fixation latitude is not smaller than 40° C. are on the practical level. The data obtained are given in Table 2.

The amount of the toners of cyan, magenta, yellow and black applied onto the image-receiving object was 0.50 mg/cm$^2$ each. (For the secondary colors of red, etc., the amount of the toners of magenta and yellow was 0.50 mg/cm$^2$each, totaling 1.0 mg/cm$^2$. The same shall apply to the other secondary colors.)

TABLE 2

| | Image Gloss on Plain Paper | OHP Transparency | Lowermost Fixation Temperature (° C.) | Offset (° C.) | Fixation Latitude | Total Evaluation |
|---|---|---|---|---|---|---|
| Example 1 | 42 | ○ | 155 | 200 ○ | ≧45° C. | ○ |
| Example 2 | 45 | ○ | 150 | 200 ○ | ≧50° C. | ○ |
| Example 3 | 40 | ○ | 160 | 200 ○ | ≧40° C. | ○ |
| Example 4 | 52 | ○ | 145 | 200 ○ | ≧55° C. | ○ |
| Example 5 | 45 | ○ | 160 | 200 ○ | ≧40° C. | ○ |
| Example 6 | 41 | ○ | 155 | 200 ○ | ≧45° C. | ○ |
| Comp. Ex. 1 | 30 | x | 180 | 200 ○ | ≧20° C. | x |
| Comp. Ex. 2 | 75 | ○ | 130 | 145 x | 10° C. | x |
| Comp. Ex. 3 | 26 | x | 180 | 200 ○ | ≧20° C. | x |
| Comp. Ex. 4 | 30 | x | 190 | 200 ○ | ≧10° C. | x |

As described in detail hereinabove with reference to its preferred embodiments, the present invention provides a toner having good offset resistance and capable of giving non-glaring, high-quality images with high OHP transparency, and also a method of image formation with it.

While the invention has been described in detail and with reference to specific embodiments thereof, it will be apparent to one skilled in the art that various changes and modifications can be made therein without departing from the spirit and scope thereof.

What is claimed is:

1. A toner comprising a binder resin, a colorant and a wax, the toner having a THF soluble component, as analyzed by gel permeation chromatography, the THF soluble component having a number-average molecular weight falling approximately between 2500 and 5500, a weight-average molecular weight falling approximately between 13000 and 25000, and a peak molecular weight falling approximately between 5000 and 15000, the THF soluble component having a component of molecular weight of at least approximately $10^5$ in a ratio of at most approximately 10% by weight of the THF soluble component and having a component of molecular weight of at least approximately $10^4$ in a ratio of approximately from 30 to 70% by weight of the THF soluble component, and the wax having a DSC endothermic peak falling approximately between 50 and 120° C.

2. The toner as claimed in claim 1, wherein the binder resin is a polyester resin.

3. The toner as claimed in claim 1, the toner having an inorganic powder on the surface.

4. The toner as claimed in claim 3, wherein the total amount of the inorganic powder is approximately from 2 to 6% by weight of the toner.

5. A two-component developer comprising a resin-coated magnetic carrier and the toner of claim 1.

6. A method of image formation comprising a step of forming a latent image on an electrostatic latent image carrier, a step of developing the latent image with a toner, a step of transferring the toner image onto an image-receiving medium, and a step of fixing the toner image on the image-receiving medium with a heating member, wherein the toner of claim 1 is used and the heating member having an elastic layer.

7. The method of image formation as claimed in claim 6, wherein the heating member having a lubricant layer which contacts with the image-receiving medium.

8. The method of image formation as claimed in claim 7, wherein the lubricant layer contains a tetrafluoroethylene/perfluoroalkyl vinyl ether copolymer, a tetrafluoroethylene/ethylene copolymer, or a tetrafluoroethylene/hexafluoroethylene copolymer.

9. The method of image formation as claimed in claim 6, wherein the heating member has two rollers, and the roller surface to be brought into contact with the toner image on the image-receiving object could be concave more than the other roll surface to form a nip.

10. The method of image formation as claimed in claim 6, wherein the heating member has a roller and a belt, and the roller is brought into contact with the toner image on the image-receiving medium.

11. The method of image formation as claimed in claim 10, wherein the roller in contact with the toner image on the image-receiving medium is dented by pressure applied thereto via the inside of the belt.

12. The method of image formation as claimed in claim 6, wherein the surface temperature of the heating member is higher at least approximately 30° C. than the DSC endothermic peak temperature of the wax in the toner.

13. The method of image formation as claimed in claim 6, wherein the heating member has a temperature control sensor on its non-imaging area.

14. The method of image formation as claimed in claim 6, wherein the toner includes a yellow toner, a magenta toner and a cyan toner.

15. The method of image formation as claimed in claim 14, wherein the toner includes a yellow toner, a magenta toner and a cyan toner, and the toner image on the image-receiving medium includes a magenta or cyan toner image and a yellow toner image as formed in that order on the image-receiving medium.

16. The method of image formation as claimed in claim 14, wherein the toner image on the image-receiving medium includes a magenta or cyan toner image, a yellow toner image, and additionally a black toner image all formed in that order on the image-receiving medium.

* * * * *